US006827072B2

(12) United States Patent
Schwämmle

(10) Patent No.: US 6,827,072 B2
(45) Date of Patent: Dec. 7, 2004

(54) DRESSING WHEEL AND METHOD OF MAKING SAME

(75) Inventor: Holger Schwämmle, Weikersheim (DE)

(73) Assignee: Wendt GmbH, Meerbusch (DE)

( * ) Notice: Subject to any disclaimer, the term of this patent is extended or adjusted under 35 U.S.C. 154(b) by 0 days.

(21) Appl. No.: 10/351,261

(22) Filed: Jan. 24, 2003

(65) Prior Publication Data

US 2003/0145843 A1 Aug. 7, 2003

(30) Foreign Application Priority Data

Jan. 25, 2002 (EP) ..... 02001779

(51) Int. Cl.[7] ..... B28D 1/04

(52) U.S. Cl. ..... 125/15; 125/11.01; 125/901; 451/541

(58) Field of Search ..... 451/541, 544, 451/547; 125/11.01, 11.18, 3, 13.01, 12, 20, 901, 15; 83/676; 51/255, 309; 228/122.1, 121, 122, 248

(56) References Cited

U.S. PATENT DOCUMENTS 2,488,276 A * 11/1949 Erickson ..... 451/544
3,092,094 A * 6/1963 Griffin et al. ..... 125/15
4,915,089 A * 4/1990 Ruark et al. ..... 125/11.03
5,261,385 A * 11/1993 Kroll ..... 125/13.01
5,271,547 A * 12/1993 Carlson ..... 228/122.1
6,213,860 B1 * 4/2001 Tunstall et al. ..... 451/541
6,371,103 B1 * 4/2002 Lupi ..... 125/40

FOREIGN PATENT DOCUMENTS

| | | |
|---|---|---|
| DE | 3811784 | 7/1989 |
| EP | 0426173 | 5/1991 |
| WO | WO-00/06340 | 2/2000 |

* cited by examiner

*Primary Examiner*—Lee D. Wilson
*Assistant Examiner*—Anthony Ojini
(74) *Attorney, Agent, or Firm*—Herbert Dubno; Andrew Wilford

(57) ABSTRACT

A dressing wheel has a disk-shaped base body centered on an axis and formed with an annular groove also centered on the axis and having an inner surface. A multiplicity of abrasive elements distributed along the groove are in direct contact with the groove inner surface. Matrix powder fills the groove between the elements and between the elements and the groove surfaces. A hardened infiltrating agent, e.g. solder, fills interstices of the matrix powder.

20 Claims, 3 Drawing Sheets

DRESSING WHEEL AND METHOD OF MAKING SAME

FIELD OF THE INVENTION

The present invention relates to a dressing wheel. More particularly this invention concerns a method of making such a wheel.

BACKGROUND OF THE INVENTION

A standard dressing wheel, as for instance used to true a grinding wheel when it has become crowned with use, is comprised of a disk-shaped core or base body centered on an axis and having a surface at which opens an annular groove in which abrasive elements or grinding particles are fixed. These elements are typically real or synthetic mono or polycrystalline diamonds.

Such a dressing wheel is made by enclosing the base body in a negative mold formed of graphite. The abrasive particles are adhered by adhesive and/or galvanically to an inner surface of the mold at a spacing from the periphery of the base body. The annular space between the abrasive particles and the body is packed with a matrix or binding powder and the interstices or pores in the powder are infiltrated by capillary action with a molten solder, drawn into place under a vacuum or atmosphere of protective gas, to bind the powder together and to both the abrasive elements and the base body. Thus the groove is filled with a mass comprised of the abrasive elements, the matrix powder, and the now hard solder. The workpiece is then cooled and stripped out of the mold.

Such a manufacturing process is quite complex, mainly because it requires the use of the negative graphite mold which often cannot be reused. In addition the abrasive elements of this dressing wheel are not very solidly mounted to the base body, mainly because they are separated from them by a considerable mass of the solder-infiltrated matrix powder.

OBJECTS OF THE INVENTION

It is therefore an object of the present invention to provide an improved dressing wheel.

Another object is the provision of an improved method of making a dressing wheel which overcomes the above-given disadvantages, that is which is relatively simple so that the wheel can be made inexpensively.

A further object is to provide a particularly robust and durable dressing wheel.

SUMMARY OF THE INVENTION

These objects are attained in a dressing wheel having according to the invention a disk-shaped base body centered on an axis and formed with an annular groove also centered on the axis and having an inner surface. A multiplicity of abrasive elements distributed along the groove are in direct contact with the groove inner surface. Matrix powder fills the groove between the elements and between the elements and the groove surfaces. A hardened liquid infiltrating agent fills interstices of the matrix powder.

Such a dressing wheel is made by first positioning abrasive elements along an annular groove opening at a face of a base body and securing the abrasive elements in the groove. Then the groove is filled between the abrasive elements and between the abrasive elements and surfaces of the groove with a fluent matrix powder. Interstices of the matrix powder are then infiltrated with a hardenable liquid infiltrating agent that is hardened to bond the matrix powder to the abrasive elements and to the groove surfaces. An outer surface of the bonded together matrix powder, hardened infiltrating agent, and abrasive elements is then machined off.

This wheel and manufacturing method have several advantages. First of all, there is no need for a sacrificial graphite mold. This alone greatly reduces the costs of manufacturing the wheel. Furthermore the abrasive elements, normally particles of real or synthetic diamond, are in direct contact with the base body, typically formed of steel, so that they are very solidly mounted and can be counted on not to shift even when subjected to exceptional stresses. The amount of matrix powder needed is substantially less than that used in a prior-art dressing wheel, where it must fill the considerable gap between the abrasive elements secured to the inside surface of the negative graphite mold and the groove surfaces, so that on the one hand this expensive material is used sparingly and on the other hand the matrix formed by the matrix powder and the hardened infiltrating agent is of minimal mass and thickness, making the finished wheel much stronger and more effectively anchoring the abrasive elements on the base disk.

According to the invention the outer surface is machined off to impart a predetermined body-of-revolution shape to the disk at the groove. This can be done when the groove opens axially and radially at a corner of the base disk by milling off an axially directed end face of the wheel and forming a frustoconical surface that meets the milled-off end face at a corner where the abrasive elements bedded in their matrix are exposed.

The matrix powder in accordance with the invention includes particles of a liquefiable and hardenable infiltrating agent, e.g. small granules of solder. The solder itself is an unactivated copper-base solder which is a relatively inexpensive product. In this case it is not necessary to operate under a high vacuum or with an expensive inert gas.

To further increase the grinding effectiveness of the finished dressing wheel, the matrix powder and/or the infiltrating agent include particles of carbide, nitride, oxide, or ceramic. This increases the wear resistance of the matrix exposed between the abrasive elements.

In order to increase the bond of the diamond abrasive elements, carbide-formers such as tungsten are added to the matrix powder and/or hardenable infiltrating agent. This simultaneously increases the wear resistance of the matrix and the strength of the bond with the abrasive elements.

The abrasive elements in accordance with the invention are secured in the groove with an adhesive, preferably one with a long setup time. A two-component adhesive can be used, even one that will not stand up to the high temperatures of the infiltrating step, since by the time the workpiece is heated to infiltrate the matrix powder with the liquid infiltrating agent, the matrix powder has already been packed in place and will hold the abrasive elements well enough until the parts cool and the actual bonds are formed. If the abrasive elements are also secured galvanically in the metallic base disk, an electrically conductive adhesive is used so that there is good current flow even in locations where the abrasive particles do not directly contact the base body.

The base body according to the invention is centered on an axis and at least some of the abrasive elements are secured in the groove in a position extending generally perpendicular to, parallel to, or at acute angles to the axis.

Thus it is possible to position the abrasive elements for maximum effectiveness in the finished dressing wheel, even stochastically if necessary.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
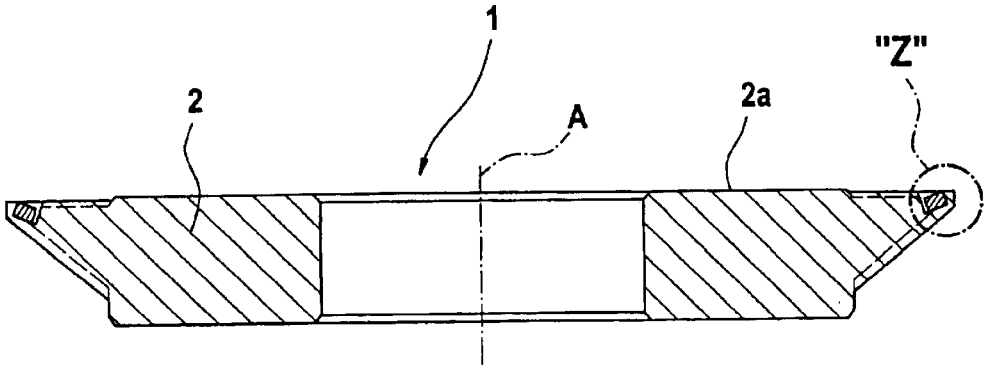
FIG. 1 is an axial section through a dressing wheel according to the invention.
Figure 2:
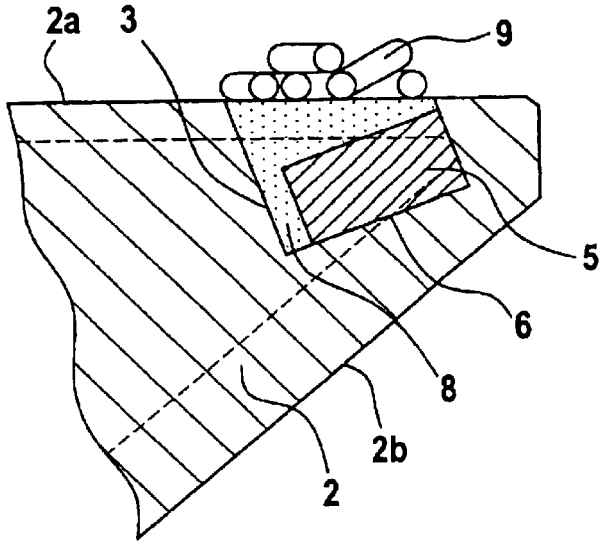
FIGS. 2, 3, and 4 are large-scale views corresponding to the detail indicated at Z in FIG. 1 of the wheel at different stages of its manufacture.
Figure 3:
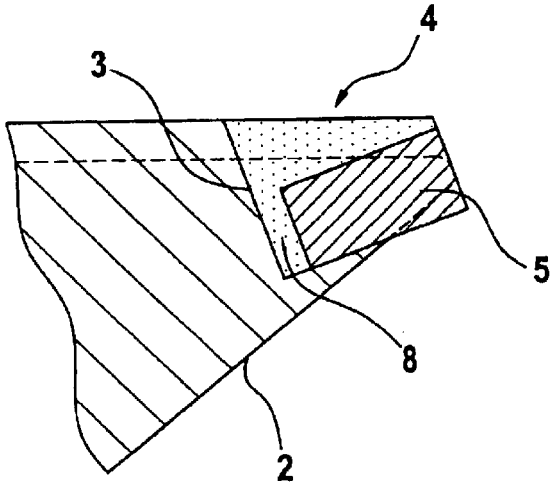
Figure 4:
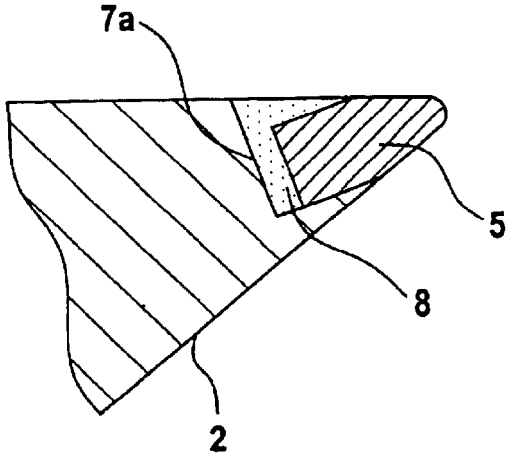

As seen in FIG. 1 a dressing wheel 1 is mainly formed by an annular steel base body or disk 2 centered on an axis A. It is formed in an outside corner as shown in FIGS. 2 through 4 with a rectangular-section groove 4 open at an axial face 2*a* of the disk 2 and having an inside surface 3. In accordance with the invention this groove 4 is first fitted with an array of abrasive elements 5 that are spaced angularly about the axis A. Some of these elements 5, which are real or synthetic diamonds, are oriented parallel to the axis A, some perpendicular thereto, and some at an acute angle to it. The abrasive elements 5 do not fill the groove 4 but are at least partially in direct contact with the surface 3. An adhesive layer 6 holds the elements 5 in place.

As shown in FIG. 2 the groove 4 is filled around the elements 5 with a mass 8 of a matrix powder that may include particles of hard solder. The mass 8 is packed in place by vibration, centrifuging, or the like. More hard solder pieces 9 are placed on the powder mass 8 at the mouth of the groove 4 as shown in FIG. 2. Abrasive particles, e.g. of carbide, can be incorporated in the matrix powder and/or in the solder to render the resultant matrix more durable and abrasive. Then the assembly is heated so that the solder 9 melts and flows by capillary action into the interstices between the particles of the mass 8. This heating can vaporize the adhesive layer 6 since, once the mass 8 is packed in place, the elements 5 will remain in position so that the adhesive is no longer needed. After the mass 8 is fully infiltrated with the molten solder, the workpiece is cooled to harden the solder and powder together into a matrix bonded to the elements 5 and to the groove surface 3.

Subsequently as shown in FIG. 3 a frustoconical back face 2*b* of the disk 2 is machined away and then the front face 2*a* as shown in FIG. 4, shaping the mass 8 and elements 5 into the configuration necessary for use of the wheel 1 in truing.

Figure 5:
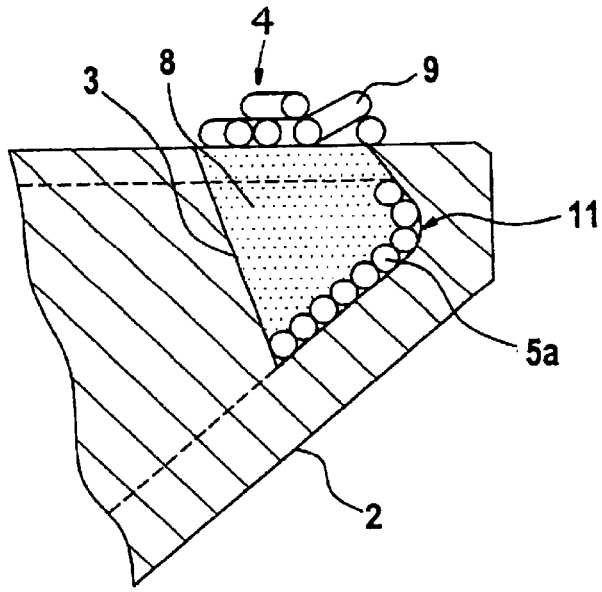
FIGS. 5, 6, and 7 are views like FIGS. 2–4 showing another wheel according to the invention in different stages of manufacture.
Figure 6:
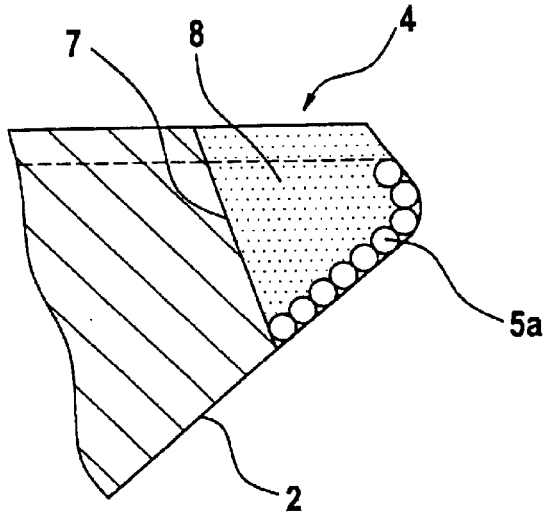
Figure 7:
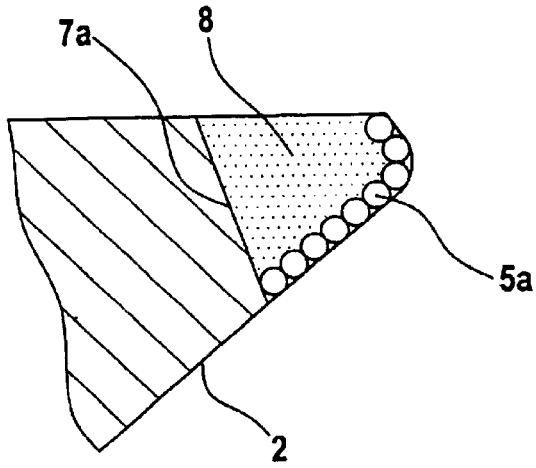

FIG. 5 shows how elements 5*a* can be distributed along a surface 11 of the groove 4. Then as shown in FIGS. 6 and 7 the back and front of the wheel 2 are milled off. The shape of the surface 11 against which the elements 5*a* lie corresponds to the finished shape of the corner of the wheel 1 so that these elements 5 are all perfectly exposed once the final machining step is complete.

I claim:

1. A method of making a dressing wheel, the method comprising the steps of sequentially:

positioning abrasive elements along an annular groove opening at a face of a base body;

securing the abrasive elements in the annular groove;

filling the annular groove between the abrasive elements and between the abrasive elements and surfaces of the annular groove with a matrix powder;

infiltrating interstices of the matrix powder with a liquid infiltrating agent;

hardening the infiltrating agent and thereby bonding the matrix powder to the abrasive elements and to the annular groove surfaces; and machining off an outer surface of the bonded together matrix powder, hardened infiltrating agent, and abrasive elements.

2. The method defined in claim 1 wherein the outer surface is machined off to impart a predetermined body-of-revolution shape to the disk at the annular groove.

3. The method defined in claim 1 wherein the matrix powder includes solder particles.

4. The method defined in claim 1 wherein the infiltrating agent is solder.

5. The method defined in claim 1 wherein the infiltrating agent is an unactivated copper-base solder.

6. The method defined in claim 1 wherein the matrix powder includes particles of carbide, nitride, oxide, or ceramic.

7. The method defined in claim 1 wherein the infiltrating agent includes particles of carbide, nitride, oxide, or ceramic.

8. The method defined in claim 1 wherein the base body is centered on an axis and at least some of the abrasive elements are secured in the annular groove with an adhesive.

9. The method defined in claim 1 wherein the base body is centered on an axis and at least some of the abrasive elements are secured in the annular groove in a position extending generally perpendicular to the axis.

10. The method defined in claim 1 wherein the base body is centered on an axis and at least some of the abrasive elements are secured in the annular groove in a position extending generally parallel to the axis.

11. The method defined in claim 1 wherein the base body is centered on an axis and at least some of the abrasive elements are secured in the annular groove in a position extending at acute angles to the axis.

12. The method defined in claim 1, further comprising the step of packing the matrix powder in the annular groove around the abrasive elements before hardening the infiltrating agent.

13. A dressing wheel comprising:

a disk-shaped base body centered on an axis and formed with an annular groove also centered on the axis and having an inner surface;

a multiplicity of abrasive elements distributed along the annular groove and in direct contact with the annular groove inner surface;

matrix powder in the annular groove between the abrasive elements and between the abrasive elements and the annular groove surface; and a hardened infiltrating agent filling interstices of the matrix powder.

14. The dressing wheel defined in claim 13 wherein the infiltrating agent is an unactivated copper-base solder.

15. The dressing wheel defined in claim 13 wherein the matrix powder includes particles of carbide, nitride, oxide, or ceramic.

16. The dressing wheel defined in claim 13 wherein the infiltrating agent includes particles of carbide, nitride, oxide, or ceramic.

17. The dressing wheel defined in claim 13 wherein at least some of the abrasive elements extend perpendicular to the axis.

18. The dressing wheel defined in claim 13 wherein at least some of the abrasive elements extend parallel to the axis.

19. The dressing wheel defined in claim 13 wherein at least some of the particles extend at acute angles to the axis.

20. The dressing wheel defined in claim 13 wherein the abrasive elements are diamond particles.

* * * * *